United States Patent [19]

Hiatt et al.

[11] 4,056,910

[45] Nov. 8, 1977

[54] STRUCTURAL BUILDING ELEMENT

[75] Inventors: Carl C. Hiatt; Nils F. Larson, both of Winston-Salem, N.C.

[73] Assignee: Hiatt-Larson Corporation, Winston-Salem, N.C.

[21] Appl. No.: 625,478

[22] Filed: Oct. 24, 1975

[51] Int. Cl.[2] ..... E04B 5/00

[52] U.S. Cl. ..... 52/600; 52/309.1

[58] Field of Search ..... 52/600, 596, 601–607, 52/608–613, 221, 309, 309.1, 309.4

[56] References Cited

U.S. PATENT DOCUMENTS

| | | | |
|---|---|---|---|
| 2,839,812 | 6/1958 | Berliner | 52/602 |
| 3,232,017 | 2/1966 | Prusinski et al. | 52/309 |
| 3,284,980 | 11/1966 | Dinkel | 52/600 |
| 3,449,879 | 6/1969 | Bloom | 52/600 X |
| 3,899,855 | 8/1975 | Gadsby | 52/90 |

*Primary Examiner*—J. Karl Bell

*Attorney, Agent, or Firm*—Bacon & Thomas

[57] ABSTRACT

A structural building element in the form of a panel or related configuration having a continuous phase of cementitious material which includes an interconnected matrix having a first density and a plurality of zones dispersed within the matrix, wherein the zones have a second density lower than the first density. Reinforcement members may be embedded within portions of the interconnected matrix to impart additional strength to the element.

22 Claims, 9 Drawing Figures

Fig. 3.
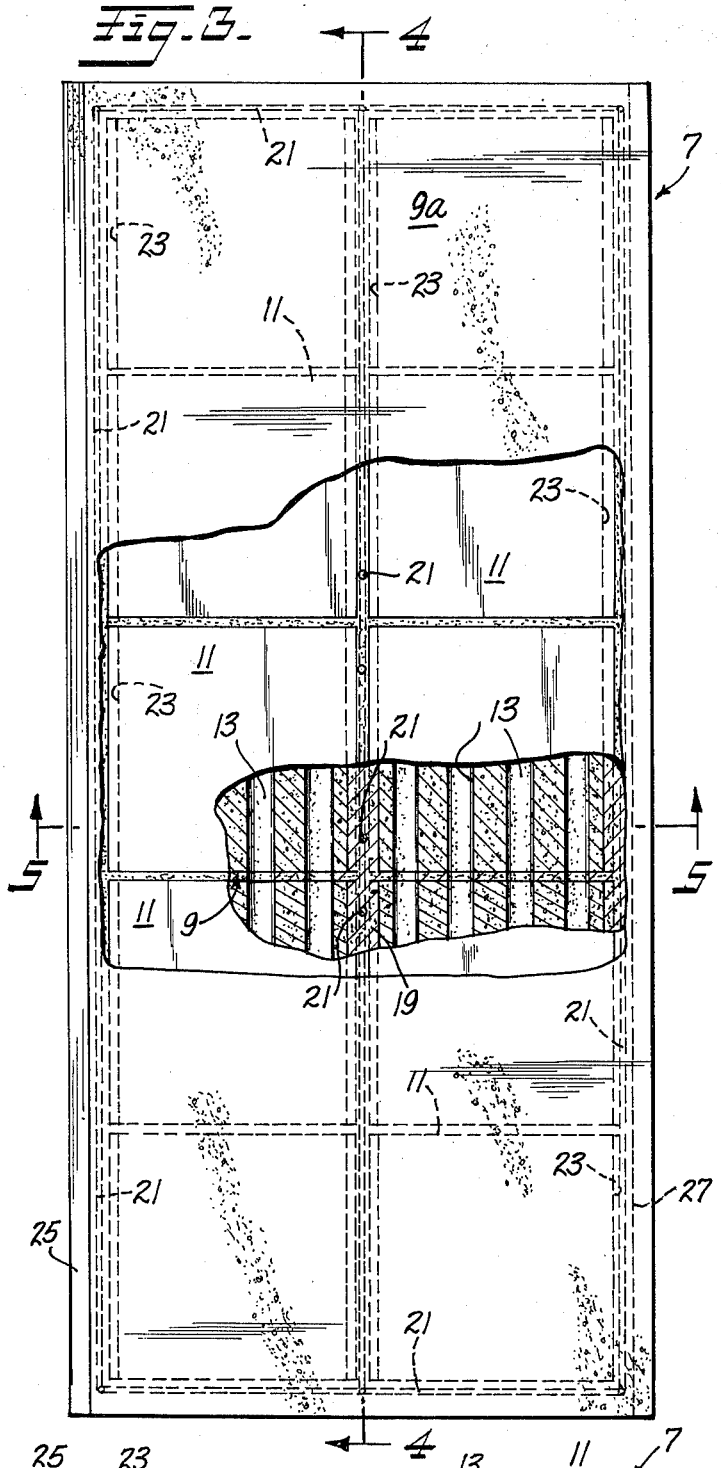
Fig. 4.
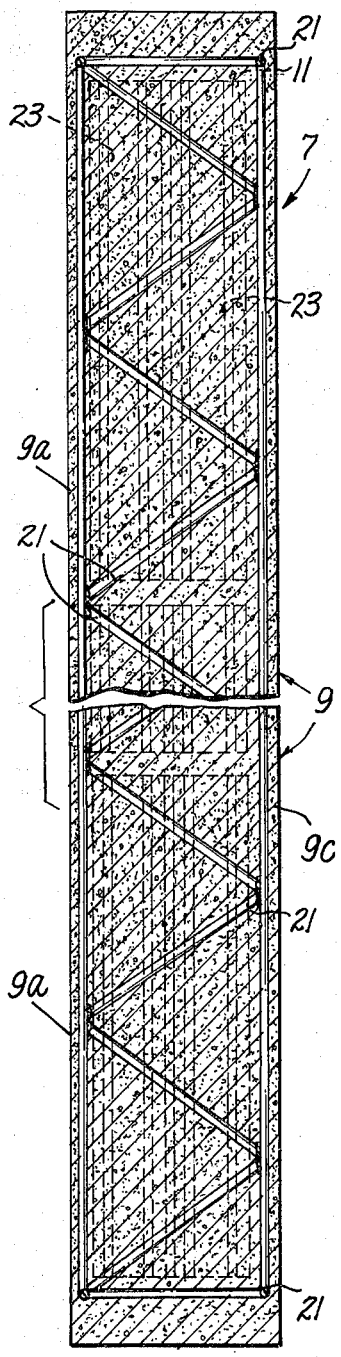
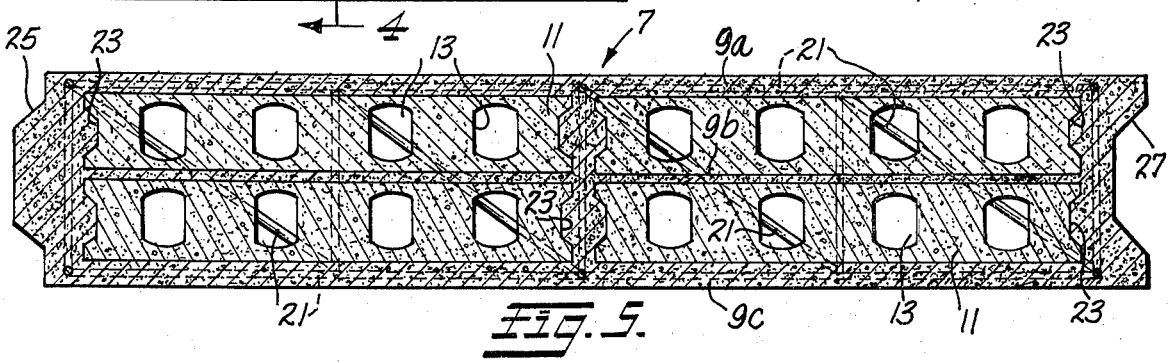
Fig. 5.

Fig. 6.
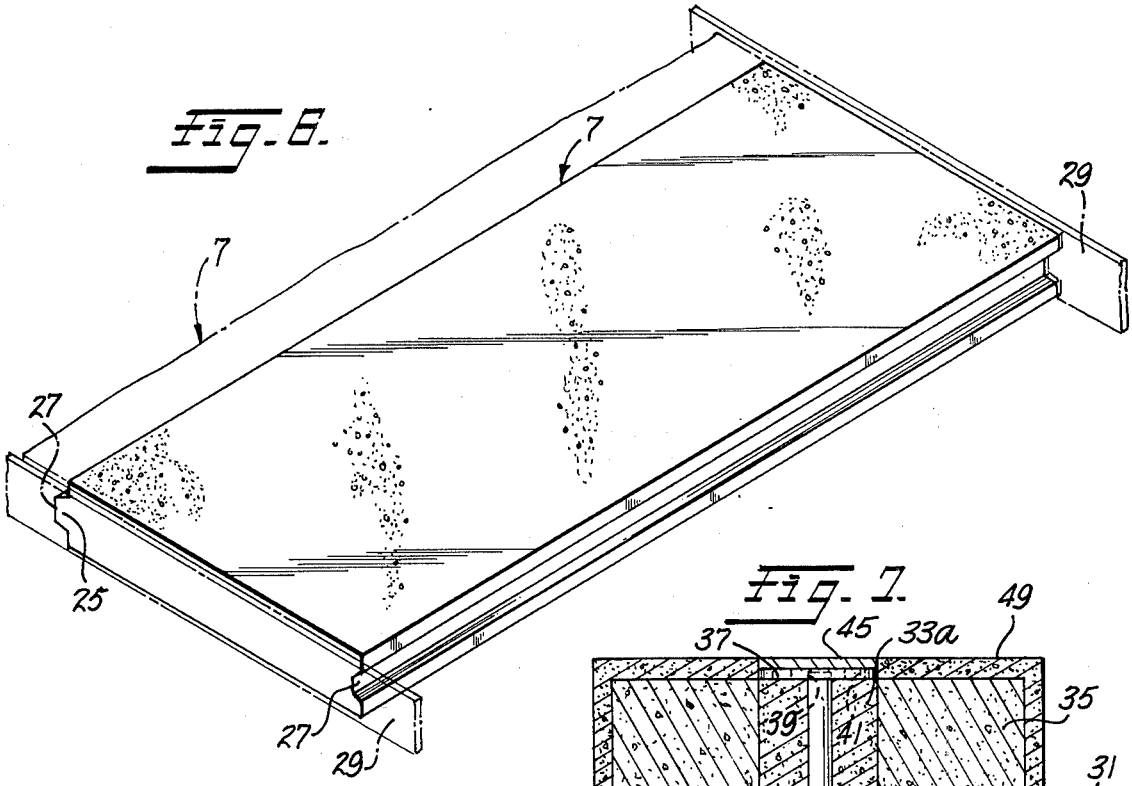
Fig. 7.
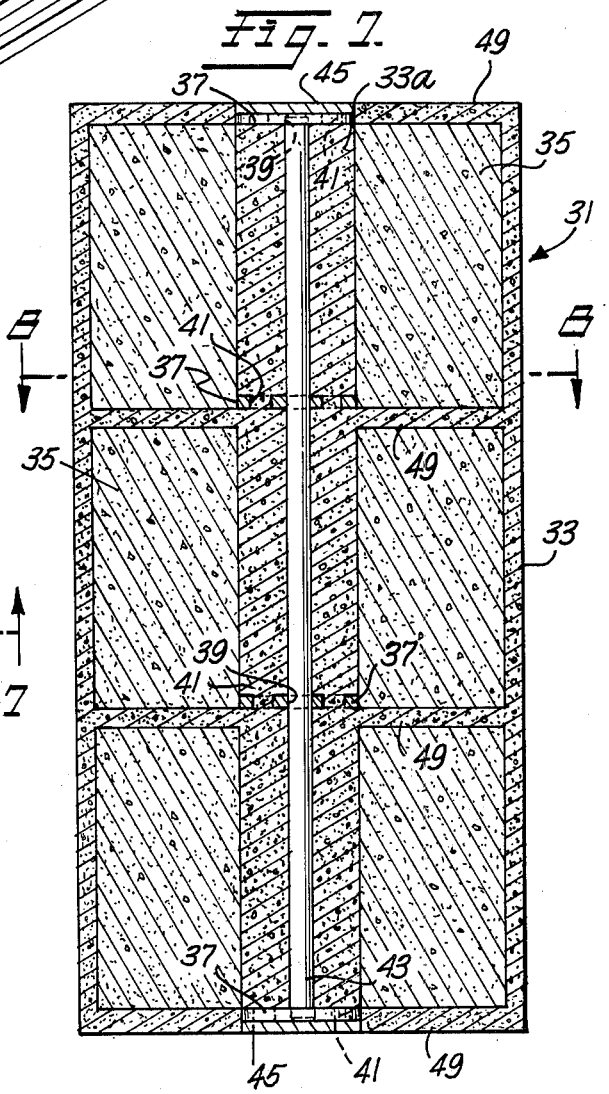
Fig. 8.
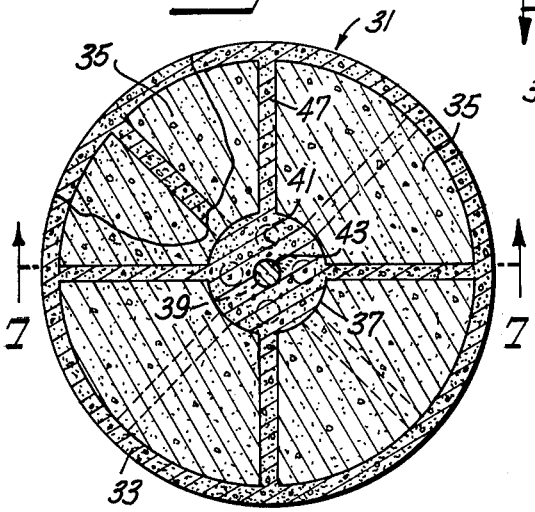
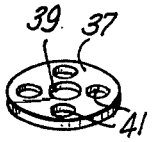
Fig. 9.

STRUCTURAL BUILDING ELEMENT

BACKGROUND OF THE INVENTION

1. Field of the Invention

This invention generally relates to the field of art which includes materials and structural elements or components for use in the building or construction industry. More particularly, this invention relates to a structural building element in the form of a panel or related shape which is particualrly useful for constructing wall, floor and/or column systems.

2. Description of the Prior Art

The prior art is replete with many forms of building or construction elements which are used to form a larger structure. Such elements may take the form of sheets, panels or columns and may be made from a variety of materials. For example, a building panel may be formed entriely from pre-cast concrete or similar cementitious material. Such a panel might also be made from a combination of cementitious material provided with internal reinforcements, such as wood or metal rods. It has also been suggested that building panels or elements may be made from various combinations of organic plastic compositions and materials.

As is evident, known building elements or panels made substantially of concrete and related cementitious materials are quite strong under compressive loading, but are difficult to handle because of their heavy weight and further do not provide good insulative qualities. The prior art attempts at utilizing organic plastics, wood and other lightweight materials for making building elements have resulted in products which possess improved insulative qualities over their concrete or cementitious counterparts, but do not begin to exhibit the compressive loading strengths inherent with the latter.

SUMMARY OF THE INVENTION

It is therefore an object of the present invention to provide an improved building element which possesses a high degree of compressive strength.

It is another object of the present invention to provide a building element which is light in weight and easily handled or manipulated.

It is a further object of the present invention to provide a building element which is characterized by good thermal and acoustical insulating qualities.

It is yet a further object of the present invention to provide for an improved building panel which is simple in construction and economical to manufacture.

The present invention serves to overcome the disadvantageous characteristics of prior art building elements and to achieve the foregoing objects by providing a building element formed entirely of a continuous phase of cementitious material, whereby the continuous phase includes an interconnected matrix having a first density which substantially completely surrounds a plurality of lower density zones dispersed within the matrix. The matrix is formed from a composition which includes cementitious material and a discontinuous phase of discrete particles, fibers or related additives which provide the matrix with a cumulative average high density. The zones dispersed within the matrix are comprised of cementitious material having dispersed therein a discontinuous phase of discrete particles, fibers or related structures of materials which provide the zones with a cumulative average low density. The element of the present invention may assume a variety of structural shapes, such as planar or columnar, and may further be provided with additional reinforcing members embedded within the matrix portion of the element.

Other objects, features and advantages of the present invention will be apparent from the following description of specific embodiments thereof, with reference to the accompanying drawings, which form a part of this specification, wherein like reference characters designate corresponding parts of the several views.

BRIEF DESCRIPTION OF THE DRAWINGS

In the Drawings:

FIG. 3 is an enlarged plan view of another embodiment of the building element of the present invention, partly broken away to show the internal structure;

FIG. 4 is an enlarged fragmentary longitudinal section view, taken on the line 4—4 of FIG. 3;

FIG. 5 is an enlarged transverse sectional view, taken on the line 5—5 of FIG. 3;

FIG. 6 is an isometric view of the building element of FIG. 3 shown in partially assembled condition, with the adjacent structure being depicted in phantom lines for purposes of clarity;

FIG. 7 is a vertical sectional view showing yet another embodiment of the building element of the present invention;

FIG. 8 is a horizontal sectional view, taken along the line 8—8 of FIG. 7, partly broken away to depict the structure of the element at a lower level; and FIG. 9 is a perspective view of one of the structural components utilized in the building element shown in FIGS. 7 and 8.

DETAILED DESCRIPTION OF PREFERRED EMBODIMENTS

Figure 1:
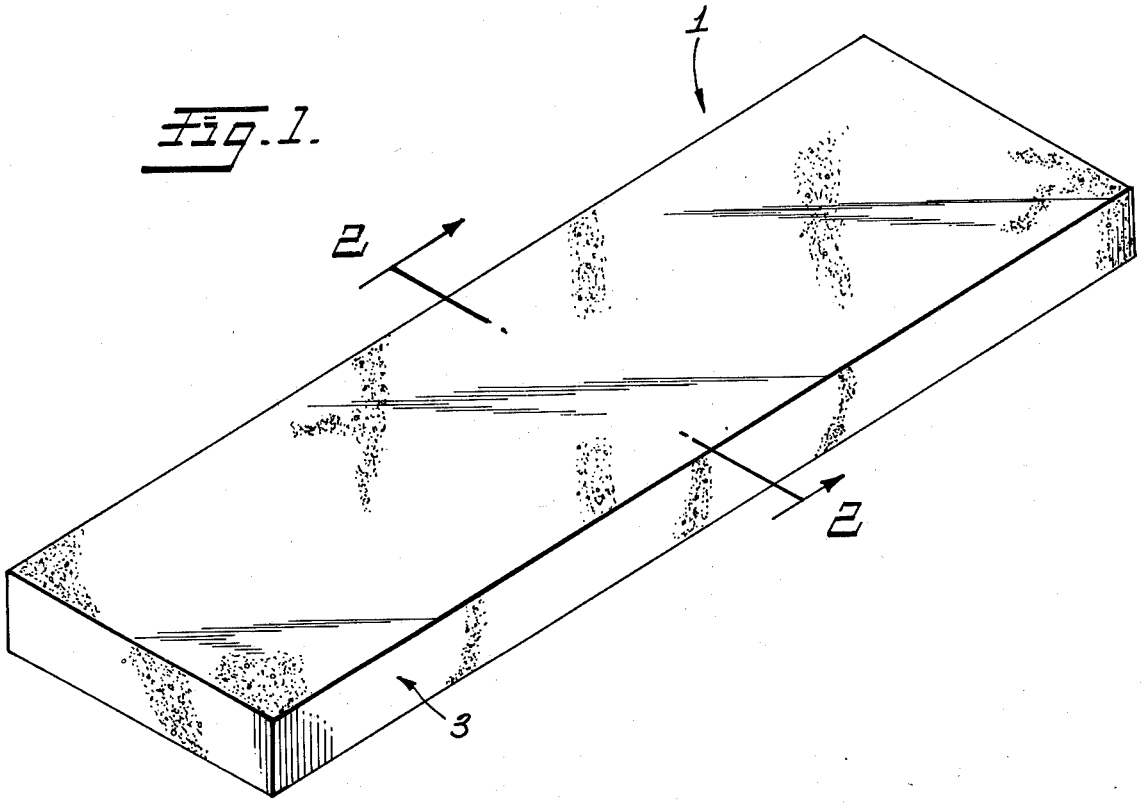
FIG. 1 is an isometric view of a building element of the present invention.
Figure 2:
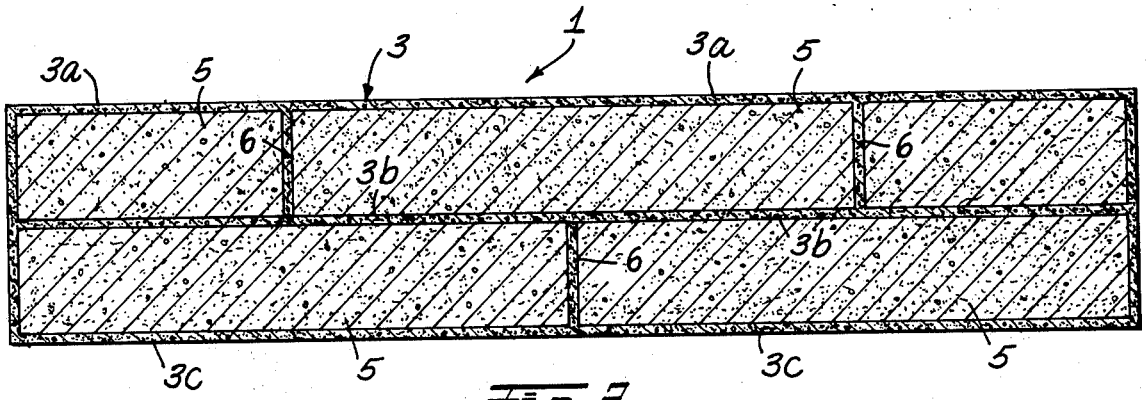
FIG. 2 is an enlarged transverse sectional view, through the element of FIG. 1, taken on the line 2—2 thereof.

Referring now to FIGS. 1 and 2 of the drawings, there is depicted and embodiment of the building element of the present invention in the form of a panel 1 having a relatively flat or planar configuration. Panel 1 includes an interconnected matrix 3 which completely surrounds and encloses a plurality of zones 5 embedded therein. As indicated in FIG. 2, the general planar structure of panel 1 is effectively provided with three continuous matrix layers 3*a*, 3*b* and 3*c*, which layers extend to the extremities of panel 1. Matrix 3 is comprised basically of inorganic cementitious material such as Portland cement based compositions, concrete, various compositions of hydraulic cement or any other such related material having a cement base. Examples of such suitable cementitious materials are disclosed in the text "Manual of Lathing and Plastering" by John R. Diehl, A.I.A., and include calcined gypsum, hydrated lime, Portland cement and admixtures thereof. Matrix 3 is also provided with a discontinuous phase or dispersion of discrete additives in the form of aggregates, particles, fibers or related such structures well known in the art for the purpose of strengthening the cementitious base of matrix 3 and providing the desired cumulative average density. Such additives may be in the form of inorganic aggregate particles, including sand, stone, marble, rock and other related materials well known in the art. Also, both organic and inorganic fibers, such as those derived from plastics, glass, asbestos, and metal, may also be utilized as additive material dispersed throughout matrix 3. It is further to be understood that any combinations or mixtures of the aforementioned additives may also be utilized to advantage in deriving the overall composition of matrix 3. However, because of the desirability of imparting hardness and strength to matrix 3, it is appropriate that the cumulative average density of matrix 3, including cemetntitious material and additives, be within the inclusive range of from 60 to 200 pounds per cubic foot, with a preferred density of matrix 3 being within the inclusive range of 90 to 150 pounds per cubic foot.

As seen in FIG. 2, zones 5 comprise generally rectangular-shaped cross-sections of material surrounded by matrix 3. However, it is understood that zones 5 may assume any suitable configuration, even free from, with the only requirement for the embodiment depicted in FIGS. 1 and 2 being that zones 5 are individually substantially entirely surrounded and enclosed within interconnected matrix 3. Matrix layers 3*a,* 3*b* and 3*c* serve to generally divide zones 5 into two tiers, spaced by a plurality of vertical walls 6, and separated by continuous central matrix layer 3*b.* By virtue of this layered arrangement, great compressive strength is imparted to overall panel 1. Though the tiers of zones 5 are depicted as rather uniform or regular staggered sections of blocks, it is to be understood that any desired arrangement or configuration of zones 5 is suitable for the practice of the present invention in a building element having a generally planar configuration. A significant aspect of such a planar configuration is the provision of at least a continuous matrix layer 3*b* disposed substantially centrally along the longitudinal axis of the element.

Like matrix 3, zones 5 are basically formed from a cementitious material, which material may comprise the same constituents or compositions as previously indicated for matrix 3. Since zones 5 are not subjected to the direct applicaton of external stress as is the case of matrix 3, it is desirable that zones 5 be of a lower density such that the entire panel 1 shall have a correspondingly lower weight. To this end, zones 5 include additives in the form of a discontinuous phase or dispersion of discrete particles which, when considered cumulatively with the cementitious material in which it is dispersed, will provide an appropriate density range inclusive of from 10 to 50 pounds per cubic foot. The referred density of zones 5 is of the range inclusive from 18 to 35 pounds per cubic foot. In order to achieve the lower density of zones 5, the cementitious material comprising the basis thereof may include additive material in the form of discrete particles having a relatively light weight, for example perlite, vermiculite, polymeric materials and mixtures thereof. The polymeric materials may advantageously be comprised of expandable of foamable particles derived from polyurethane, polystyrene polyolefin or similar such resins. Further, plastic or polymeric materials of the non-foamable or non-expandable type may also be utilized to advantage.

Because of the similar cementitious material utilized as the basis of the composition for matrix 3 as well as that of zones 5, panel 1 can thus be defined as an integral and continuous phase of cementitious material. Notwithstanding variation between the average densities of higher density matrix 3 and lower density zones 5, by virtue of the different additive materials incorporated therein, matrix 3 is rigidly and strongly bound to zones 5 and vice versa by virtue of the cementitious material being common to both. This unique relationship of materials results in panel 1 having an extremely high degree of compressive strength, based primarily upon the interconnected high density matrix 3 which produces a cellular structure that exhibits good load absorption characteristics. Thus, when a load is applied to panel 1, the energy of compression and bending of matrix 3 is absorbed by zones 5, thereby permitting panel to be subjected to stress conditions that would normally cause failure of known concrete or cement panels. Such strength characteristics of panel 1 make it particularly useful and safe for building in earthquake prone locations.

Panel 1 is also characterized by comparatively light weight, when compared to prior art panels made of concrete or cement, by virtue of zones 5 having a comparatively low average density because of the discrete lightweight particles dispersed therein. Accordingly, the preferred cumulative average density of panel 1 is of a range inclusive from 20 to 200 pounds per cubic foot. As is therefore evident, a building element constructed according to the present invention can be varied greatly in overall weight in order to accommodate its desired manner or environment of use.

Further, if panel 1 is to be utilized in an environment whereby a face thereof is to be exposed to the exterior, such as in a wall of a building, the matrix portion so exposed may include a larger amount of additive material in the form of rock or aggregate particles so that it will have maximum physical resistance to varying and extreme weather conditions. Similarly, should it be desired that a face of panel 1 be utilized as an interior wall of a building or the like, the portion of matrix 3 forming such an interior face may include additive material comprising a greater amount of, or be entirely of, organic or inorganic fibers since the interior face will not be subjected to harsh weather conditions or other severe structural abuse, thereby reducing the overall weight of panel 1. It is clearly understood that the respective additive materials utilized in both matrix 3 and zones 5 may be varied in composition and amount throughout the entire panel 1 if such variation is deemed desirable or necessary.

Referring now to FIGS. 3 through 5, there is depicted another embodiment of the building element of the present invention. In this embodiment, the element is also in the form of a panel 7 which includes an interconnected higher density matrix 9 and a plurality of lower density zones or blocks 11 dispersed within and surrounded by matrix 9. The compositions of matrix 9 and blocks 11 may be the same as that previously indicated for matrix 3 and zones 5, respectively, of the embodiment depicted by FIGS. 1 and 2. As similarly indicated for panel 1 of FIGS. 1 and 2, panel 7 also includes three continuous spaced matrix layers 9*a,* 9*b* and 9*c* which serve to enclose and divide blocks 11 into two separate tiers. Central matrix layer 9*b,* extending transversely and longitudinally to the extremities of panel 7 serves as the foundation for the great compressive strength of panel 7.

As seen more clearly in FIGS. 3 and 5, blocks 11 are of substantially rectangular-shape and have voids 13 provided therethrough. Blocks 11 are disposed in linear parallel array along the longitudinally axis of panel 7 such that voids 13 of adjacent blocks are aligned to form a series of parallel channels 15 throughout the length of panel 7, as clearly depicted in the cut-away section of FIG. 3. The number of channels 15 formed in panel 7 according to this manner will vary with the number of voids 13 provided in each individual block 11. If desired, only one such channel 15 may be provided in the entire panel or a parallel series of channels may be formed as shown in FIGS. 3 and 5. Channels 15 may be utilized to receive electrical wiring, cables or conduits if panel 7 is employed in the construction of a building or similar structure. Voids 13 may be filled with insulation material to better control thermal and acoustical transmissions through panel 7. Also, voids 13 may to be used for reducing substantially the weight of individual blocks 11, thereby serving to lighten the overall weight of panel 7. To this latter end, it is entirely possible that voids 13 in blocks 11 may be provided as needed for purposes of weight reduction and, as such, it would not then be necessary to align voids 13 to form continuous channels 15.

As seen in FIG. 3, matrix 9 of panel 7 substantially completely encloses and surrounds blocks 11 with the exception of the portions of spaces 17 between adjacent blocks where voids 13 are aligned to form channels 15. For added overall strength, a continuous section of matrix 9 is disposed substantially along the longitudinal axis of panel 7, as indicated at 19, to still further increase the overall strength and rigidity of panel 7. For even further strengthening of panel 7, reinforcing members 21 in the form of metal rods may be dispersed and embedded within matrix 9 along the outer peripheral edge of the panel as well as through the portion of matrix 9 disposed along the longitudinal axis of the element as indicated at 19. In order to assure a strong cementitious bond between matrix 9 and blocks 11, the latter may be provided with grooves 23 along the edge portions thereof, thereby affording a greater surface area for bonding. It is to be understood that panel 7 may also be reinforced by any well known reinforcement materials or members well known in the art for this purpose. For example, instead of rods 21, matrix 9 may be embedded with reinforcing members in the form of mesh structures, truss structures, pre-stressed metallic cables, or similar systems and devices well known in the art for this purpose.

Panel 7, as seen in FIG. 5, may also be provided with a male tongue or ridge 25 and a corresponding female groove or channel 26 along its opposite longitudinal edges for the purpose of facilitating the interlocking of adjacent panels together, as shown in FIG. 6. Both tongue 25 and groove 27 serve to facilitate the handling and manipulation of panel 7 during construction use. Wood plates 29 may also be utilized to secure the upper or lower portions of adjacent panels together in wood construction environments.

FIGS. 7 and 8 depict yet another embodiment of the building element of the present invention. In this case, the element is in the form of a column 31. Though column 31 is depicted as having a generally circular cross-section, it is to be understood that any other cross-sectional configuration or design, such as triangular, rectangular, square or the like, may be utilized according to the desires and needs of any given application of the present invention.

As in the case of the two earlier described embodiments, column 31 comprises a third embodiment which also includes an interconnected higher density matrix 33 which surrounds and encloses a plurality of lower density zones 35. The compositions, materials and densities of matrix 33 and zones 35 are the same as those indicated for the eariler described embodiments.

Disposed substantially centrally and along the longitudinal axis of column 31 is a continuous and relatively thick portion of matrix 33, as indicated at **33*a*. Spaced centrally along the lenth of matrix 33*a* are a plurality of apertured washers 37. As depicted in FIG. 9, each washer 37 may be of circular configuration and provided with a central aperture 39 and a plurality of circumferential apertures 41 surrounding aperture 39. A steel reinforcing rod 43 may be passed through the aligned central apertures 39 of washers 37 to impart additional strength and ridigity to column 31. Washers 37 are securely held in place with matriix 33*a* which becomes embedded through circumferential apertures 41. Outermost washers 37, located at the outer ends of column 31, may be covered by correspondingly shaped solid metal plates 45 which are sealed and secured in place by means of matrix 33.**

As seen in FIGS. 7 and 8, lower density zones 35 may assume the configuration of generally arcuate sections surrounded on all sides by a plurality of internal vertical walls 47 and a plurality of horizontal walls 49 of matrix 33, in addition to central matrix **33*a* and the outer cylindrical wall portion of matrix 33. In this structure, vertical walls 47 may be spaced 90° apart in successive vertical tiers separated by horizontal walls 49. However, adjacent tiers of vertical walls 47 may be offset from each other by 45° as indicated in the cut-away section of FIG. 8 to further increase the overall compressive strength of column 31.**

In a preferred embodiment of the present invention, which embodiment is to be understood as exemplary and not limiting, a building element was formed from compositions as follows: For the high density matrix, 2,660 pounds of sand having an ASTM specification of C332 of Group 1 were mixed with 9 sacks of cement (about 94 pounds/sack) and 54 gallons of water. This produced one cubic yard of matrix composition. For the low density zones, 6.75 sacks of cement (about 94 pounds/sack) were mixed with 27 cubic feet of perlite (about 8 pounds/ft.$^3$) and 61 gallons of water to produce one cubic yard of low density zone composition.

The final high density composition was approximately 150 pounds per cubic foot. The final low density composition was approximately 36 pounds per cubic foot. However, by varying the amounts of sand and perlite, the respective perferred high and low densities were ascertained to be on the order of about 90–150 pounds per cubic foot and 22–36 pounds per cubic foot. The overall density of the formed building element will vary, of course, depending upon the configuration and sizes of the low density zones and the thickness of the high density matrix.

A preferred embodiment of a building element utilizing the latter described compositions may assume a generally planar configuration similar to panel 1 of FIG. 1 or panel 7 of FIG. 3. The interconnected matrix, having a density of approximately 150 pounds per cubic foot, substantially completely surrounds the plurality of lower density zones with the latter having a density of approximately 36 pounds per cubic foot. The matrix effectively includes three spaced sections which divide the zones into two portions or tiers. The spaced sections of matrix are continuous and extend to the extremities of the panel in the manner as indicated for panel 1 in FIG. 2 and the panel 7 in FIG. 5.

The building element of the present invention may be made by first individually molding the lower density zones from the desired composition. The molded zones, in the form of blocks or other shapes, are then placed, while still in a "green" state, in a larger mold having the form of the finished element. The zones are spaced from each other and from the walls of the larger mold. The desired matrix composition is then injected into the spaces of the latter mold such that it surrounds and embeds each zone in matrix material and completely fills the spaces. Because the zones are utilized in a "green" condition, the cementitious material in the matrix form a secure bond with the cementitious material in the zones to thereby create a continuous cementitious phase throughout the entire element.

The building element may also be made by continuously extruding a layer of matrix between and around a succession of zones in the form of blocks or other shapes.

It is to be understood that the forms of the invention herewith shown and described are to be taken as preferred examples of the same, and that various changes in the shape, size and arrangement of parts and compositions may be resorted to, without departing from the spirit of the invention or scope of the subjoined claims.

What is claimed is:

1. A building element having a high structural load bearing capacity and comprising:

a. a continuous phase of cementitious material, wherein said continuous phase includes:

b. an interconnected matrix in the form of a cellular structure and having a first density, and c. a plurality of zones dispersed within the matrix having a second density lower than the first density, wherein the matrix comprises a plurality of wall sections substantially completely surrounding the lower density zones with at least one portion of the matrix disposed interiorly of the element between said low density zones for interconnecting opposed wall sections of the matrix, and d. a common cementitious bond between the wall sections of the matrix, the interiorly disposed interconnecting portion of the matrix, and the lower density zones for producing a synergistic relationship imparting increased compressive strength and minimization of fracture propagation throughout the element.

2. The element of claim 1 wherein each lower density zone includes at least one void formed therein.

3. The element of claim 1 wherein the matrix includes reinforcing members embedded therein.

4. The element of claim 1 wherein:

a. the first density is of a range from about 60 to 200 pounds per cubic foot, and b. the second density is of a range of from about 10 to 50 pounds per cubic foot.

5. The element of claim 1 wherein the overall average density of the element is of an inclusive range from about 20 to 200 pounds per cubic foot.

6. The element of claim 1 wherein:

a. the matrix has a composition including a continuous phase of cementitious material and a first discontinuous phase selected from the group consisting of aggregate particles, organic fibers, inorganic fibers and mixtures thereof, and b. each lower density zone has a composition including a continuous phase of cementitious material and a second discontinuous phase of a filler having a density lower than the density of the cementitious material.

7. The element of claim 6 wherein the filler is selected from the group consisting of perlite, vermiculite, expandable polymers and mixtures thereof.

8. The element of claim 7 wherein:

a. the interconnected matrix has a density inclusive of the range of 90 to 150 pounds per cubic foot and the first discontinuous phase is aggregate, and b. each lower density zone has a density inclusive of the range of 22–36 pounds per cubic foot and the second discontinuous phase is perlite.

9. The element of claim 1 wherein:

a. the element is of substantially rectangular configuration, and b. the lower density zones are defined by substantially rectangular-shaped blocks.

10. The element of claim 9 wherein each rectangular-shaped block is provided with at least one groove along a side thereof.

11. The elements of claim 1 wherein the element is of a substantially planar configuration with:

a. the portion of the matrix forming one face including a discontinuous phase selected from the group consisting of organic fibers, inorganic fibers and mixtures thereof, and b. the portion of the matrix forming the opposing face including a discontinuous phase of aggregate particles.

12. The building element of claim 1 wherein:

a. the interconnected matrix has a density in the range of from about 60 to 200 pounds per cubic foot and includes:

1. a continuous phase of cementitious material, and 2. a first discontinuous phase selected from the group consistng of aggregate particles, organic fibers, inorganic fibers and mixtures thereof; and b. each of the lower density zones has a density in the range of from about 10 to 50 pounds per cubic foot, with each lower density zone including:

1. a continuous phase of cementitious material, and 2. a second discontinuous phase of a filler selected from the group consisting of perlite, vermiculite, expandable polymers and mixture thereof.

13. The element of claim 12 wherein a. the element is of substantially rectangular configuration, and b. the lower density zones are defined by substantially rectangular-shaped blocks with each block having at least one void formed therein.

14. The element of claim 13 wherein a. the overall average density of the element is of and inclusive range from about 20 to 200 pounds per cubic foot, and b. the matrix includes reinforcing members embedded therein.

15. The element of claim 12 wherein:

a. the element has a substantially circular cross-sectional configuration, and b. each zone has a substantially arcuate configuration.

16. A building element having a substantially elongate configuration and comprising:

a. a continuous phase of cementitious material, wherein said continuous phase includes:

b. an interconnected matrix having a first density, wherein a portion of the matrix is disposed substantially along the longitudinal axis of the cement, and c. a plurality of zones dispersed within the matrix having a second density lower than the first density.

17. The element of claim 16 wherein:

a. the element has a substantially circular cross-sectional configuration, and b. each zone has a substantially arcuate configuration.

18. The element of claim 17 wherein the zones are spaced along a series of tiers with wall sections of matrix separating adjacent zones.

19. A building element having a planar configuration and comprising:

a. a continuous phase of cementitious material, wherein said continuous phase includes:

b. an interconnected matrix having a first density, wherein the matrix includes at least three spaced continuous layers extending to the longitudinal and transverse extremities of the element, and c. a plurality of zones dispersed within the matrix having a second density lower than the first density.

20. A building element comprising:

a. a continuous phase of cementitious materials, wherein said continuous phase includes:

b. an interconnected matrix having a first density, wherein a portin of the matrix is disposed along the geometric central region of the element, and c. a plurality of zones dispersed within the matrix having a second density lower than the first density.

21. A building element comprising:

a. a continuous phase of cementitious material, wherein said continuous phase includes:

b. an interconnected matrix in the form of a cellular structure and having a density in the range of from about 60 to 200 pounds per cubic foot, which matrix includes:

1. a continuous phase of cementitious material, and
2. a first discontinuous phase selected from the group consisting of aggregate particles, organic fibers, inorganic fibers and mixtures thereof; and c. a plurality of zones having a density in the range of from about 10 to 50 pounds per cubic foot dispersed within and surrounding by the matrix, each of which zones includes:

1. a continuous pase of cementitious material, and
2. a second discontinuous phase of a filler selected from the group consisting of perlite, vermiculite, expandable polymers and mixtures thereof;

wherein the zones are spaced along a series of tiers with wall sections of matrix separating adjacent zones and the common cementitious bond between the matrix and the lower density zones produces a synergistic relationship for imparting increased compressive strength and minimization of fracture propagation throughout the element.

22. A building element having a planar configuration and comprising:

a. a continuous phase of cementitious material, wherein said continuous phase includes:

b. an interconnected matrix in the form of a cellular structure and having a density in the range of from about 60 to 200 pounds per square foot, which matrix includes:

1. a continuous phase of cementitious material,
2. a first discontinuous phase selected from the group consisting of aggregate particles, organic fibers, inorganic fibers and mixtures thereof; and
3. at least three spaced continuous layers extending to the longitudinal and transverse extremities of the element; and c. a plurality of zones having a density in the range of from about 10 to 50 pounds per cubic foot dispersed within one surrounded by the matrix, each of which zones includes:

1. a continuous phase of cementitious material, and
2. a second discontinous phase of filler selected from the group consisting of perlite, vermiculite, expandable polymers and mixtures thereof;

wherein the common cementitious bond between the matrix and lower density zones produces a synergistic relationship for imparting increased compressive strength and minimization of fracture propagation throughout the element.

* * * * *